US008178184B2

(12) United States Patent
Yasuda et al.

(10) Patent No.: US 8,178,184 B2
(45) Date of Patent: May 15, 2012

(54) PROCESS FOR PRODUCING INTERTWINED ULTRAFINE FILAMENT SHEET

(75) Inventors: Yoshiaki Yasuda, Kurashiki (JP); Jiro Tanaka, Kurashiki (JP); Yoshiyuki Ando, Kurashiki (JP); Yoshiki Nobuto, Kurashiki (JP); Kimio Nakayama, Kurashiki (JP); Yoshihiro Tanba, Kurashiki (JP); Tsuyoshi Yamasaki, Kurashiki (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 1019 days.

(21) Appl. No.: 11/629,697

(22) PCT Filed: Jun. 15, 2005

(86) PCT No.: PCT/JP2005/010937

§ 371 (c)(1),
(2), (4) Date: Dec. 15, 2006

(87) PCT Pub. No.: WO2005/124002

PCT Pub. Date: Dec. 29, 2005

(65) Prior Publication Data

US 2008/0095972 A1 Apr. 24, 2008

(30) Foreign Application Priority Data

Jun. 17, 2004 (JP) ..... 2004-179682
Jun. 17, 2004 (JP) ..... 2004-179683

(51) Int. Cl.

| | |
|---|---|
| ***B32B 5/02*** | (2006.01) |
| ***D01F 11/04*** | (2006.01) |
| ***D06C 21/00*** | (2006.01) |
| ***D04H 3/10*** | (2012.01) |

(52) U.S. Cl. ..... 428/91; 428/151; 428/904; 442/60; 28/107; 26/18.5; 26/18.6; 26/29 R; 8/115.51; 8/115.54; 8/115.55; 264/171.1; 264/211.12

(58) Field of Classification Search ..... 428/91, 428/904, 151; 28/107; 26/18.5, 18.6, 29 R; 8/115.51, 115.54; 442/60, 63, 340; 264/171.1, 264/211.12
See application file for complete search history.

(56) References Cited

U.S. PATENT DOCUMENTS

| | | | | |
|---|---|---|---|---|
| 3,245,863 | A * | 4/1966 | Sonnichsen et al. | 442/280 |
| 3,713,219 | A * | 1/1973 | Fleissner | 26/18.5 |
| 3,723,161 | A * | 3/1973 | Fleissner | 427/278 |
| 3,795,031 | A * | 3/1974 | Fleissner | 26/18.5 |
| 3,889,325 | A * | 6/1975 | Fleissner | 26/18.5 |
| 4,833,012 | A * | 5/1989 | Makimura et al. | 442/329 |
| 5,290,626 | A * | 3/1994 | Nishioi et al. | 442/201 |
| 5,899,785 | A * | 5/1999 | Groten et al. | 442/334 |
| 6,451,404 | B1 * | 9/2002 | Nobuto et al. | 428/91 |
| 6,479,153 | B1 * | 11/2002 | Kato et al. | 428/423.7 |
| 6,517,938 | B1 * | 2/2003 | Andoh et al. | 428/395 |
| 6,641,619 | B1 * | 11/2003 | Nobuto et al. | 8/115.6 |
| 6,733,859 | B2 * | 5/2004 | Yoneda et al. | 428/91 |
| 6,739,076 | B2 * | 5/2004 | Yoneda et al. | 36/98 |
| 6,767,853 | B1 * | 7/2004 | Nakayama et al. | 442/361 |
| 6,900,148 | B2 * | 5/2005 | Yoneda et al. | 442/341 |
| 7,025,915 | B2 * | 4/2006 | Wang et al. | 264/103 |
| 7,091,139 | B2 * | 8/2006 | Nobuto et al. | 442/136 |
| 7,105,227 | B2 * | 9/2006 | Yasuda et al. | 428/365 |
| 7,122,596 | B2 * | 10/2006 | Kato et al. | 524/507 |
| 7,132,024 | B2 * | 11/2006 | Wang et al. | 156/148 |
| 7,462,386 | B2 * | 12/2008 | Yamasaki et al. | 428/91 |
| 7,494,697 | B2 * | 2/2009 | Wang et al. | 427/595 |
| 7,704,900 | B2 * | 4/2010 | Yoshimoto et al. | 442/361 |
| 2003/0204942 | A1 * | 11/2003 | Wang et al. | 28/169 |
| 2004/0045145 | A1 | 3/2004 | Wang et al. | |
| 2004/0063366 | A1 * | 4/2004 | Nakayama et al. | 442/104 |
| 2004/0242100 | A1 * | 12/2004 | Nobuto et al. | 442/104 |
| 2005/0084719 | A1 * | 4/2005 | Yoshimoto et al. | 428/904 |
| 2005/0118394 | A1 * | 6/2005 | Tanaka et al. | 428/151 |
| 2005/0125907 | A1 * | 6/2005 | Yamasaki et al. | 8/94.19 R |
| 2006/0057432 | A1 * | 3/2006 | Feng et al. | 428/904 |
| 2007/0166509 | A1 * | 7/2007 | Horiguchi et al. | 428/91 |
| 2008/0095972 | A1 * | 4/2008 | Yasuda et al. | 428/85 |
| 2009/0053948 | A1 * | 2/2009 | Fujisawa et al. | 442/164 |
| 2009/0274862 | A1 * | 11/2009 | Nakayama et al. | 428/91 |
| 2010/0086738 | A1 * | 4/2010 | Tanaka et al. | 428/151 |

FOREIGN PATENT DOCUMENTS

| | | | |
|---|---|---|---|
| EP | 0 498 672 | A2 | 8/1992 |
| EP | 1 243 691 | A1 | 9/2002 |
| JP | 5-71006 | | 3/1993 |
| JP | 8-246336 | | 9/1996 |
| JP | 10-53948 | | 2/1998 |
| JP | 2000-110060 | | 4/2000 |
| JP | 2001-192980 | | 7/2001 |
| JP | 2003-328276 | | 11/2003 |
| JP | 2006176898 | A * | 7/2006 |
| WO | WO 03012190 | A1 * | 2/2003 |

OTHER PUBLICATIONS

English translation (by machine) of JP 2003-328276 A (Nov. 19, 2003).*

* cited by examiner

*Primary Examiner* — Cheryl Juska
(74) *Attorney, Agent, or Firm* — Oblon, Spivak, McClelland, Maier & Neustadt, L.L.P.

(57) ABSTRACT

A method of producing an entangled sheet of microfine long fibers using long fibers for forming microfine fibers. The method includes a step of forming a long-fiber web made of long fibers for forming microfine fibers, at least one component of the long fibers being a water-soluble, thermoplastic polyvinyl alcohol resin; a step of entangling the long-fiber web to form a long-fiber entangled sheet; a step of shrinking the long-fiber entangled sheet to form a long-fiber shrunk sheet; and a step of converting the long fibers for forming microfine fibers in the long-fiber shrunk sheet to microfine long fibers, thereby producing the entangled sheet of microfine long fibers. The step of entangling is conducted so as to allow the long-fiber entangled sheet to have an interlaminar peel strength of 2 kg/2.5 cm or more. The step of shrinking is conducted so as to shrink in an areal shrinkage of 35% or more.

18 Claims, No Drawings

PROCESS FOR PRODUCING INTERTWINED ULTRAFINE FILAMENT SHEET

This application is a 371 of PCT/JP05/10937 filed Jun. 15, 2005.

TECHNICAL FIELD

The present invention relates to a method for producing an entangled sheet of microfine long fibers which is suitable as a substrate for leather-like sheets, and further relates to a method for producing a substrate for leather-like sheets impregnated with an elastic polymer.

BACKGROUND ART

Leather-like sheets such as artificial leathers come to be accepted by consumers because of their superiority in light weight and easiness of handling to natural leathers, and have been widely used in clothes, general materials, sport goods and other products.

Known artificial leathers are generally produced by the following outlined method: making composite fibers for forming microfine fibers composed of two kinds of polymers having different solubility into staples; making the staples into a web by a card, crosslapper or random webber; needle-punching the web to form a fiber-entangled nonwoven fabric; impregnating an elastic polymer such as polyurethane into the nonwoven fabric; and then converting the composite fibers to microfine fibers by removing one component in the composite fibers to form a soft artificial leather.

As compared with the nonwoven fabrics made of short fibers, the nonwoven fabrics made of long fibers is advantageous because the production thereof does not need a set of large apparatuses such as an apparatus for supplying raw fibers, an apparatus for opening fibers and a carding machine. The nonwoven fabrics made of long fibers are also advantageous over the nonwoven fabrics made of short fibers in the strength.

It has been tried to produce the substrate of leather-like sheets from a nonwoven fabric made of long fibers. However, the substrate of the grain-finished artificial leathers on the market is made of regular fibers having a fineness of 0.5 dtex or more, and the artificial leather made of microfine long fibers is not yet on the market. This may be due to the difficulty of producing a long-fiber entangled sheet having a stable mass per unit area, the difficulty of handling the composite spun long fibers for forming microfine fibers, and the uneven product quality because of the uneven fineness and distortion of composite long fibers. In fact, if the nonwoven fabric is produced from microfine long fibers in the same method as employed in the production using short fibers, the sheet is wrinkled in the step of converting to microfine fibers, the dyeing step and other steps, to make the stable production difficult.

To remove such unevenness, proposed is a method in which long fibers are partly cut out to partly reduce the distortion (Patent Document 1). However, this method reduces the benefit of improving the strength by the long fiber length and fails to take full advantage of long fibers in some cases. Also proposed is a method in which a long-fiber nonwoven fabric is reinforced by a woven or knitted fabric to prevent the change in the shape of a composite sheet (Patent Document 2). However, the mere use of a reinforcing fabric cannot resist the relaxation of fiber distortion, to likely cause the wrinkling.

Patent Document 1: JP 2000-273769A

Patent Document 2: JP 64-20368A

DISCLOSURE OF INVENTION

An object of the present invention is to provide a method of producing an entangled sheet of microfine long fibers, which enables the use of microfine long fibers in the production of a substrate for leather-like sheets, although hitherto not applicable to such production.

As a result of extensive research in view of achieving the above object, the inventors have reached the present invention. Namely, the present invention provides a method of producing an entangled sheet of microfine long fibers, which include a step of forming a long-fiber web made of long fibers for forming microfine fibers, at least one component of the long fibers being a water-soluble, thermoplastic polyvinyl alcohol resin; a step of entangling the long-fiber web to form a long-fiber entangled sheet; a step of shrinking the long-fiber entangled sheet to form a long-fiber shrunk sheet; and a step of converting the long fibers for forming microfine fibers in the long-fiber shrunk sheet to microfine long fibers, thereby producing an entangled sheet of microfine long fibers, in which the step of entangling the long-fiber web is performed such that the long-fiber entangled sheet has an interlaminar peel strength of 2 kg/2.5 cm or more, and the step of shrinking the long-fiber entangled sheet is performed such that an areal shrinkage is 35% or more.

The present invention further provides a method of producing a substrate for leather-like sheets, which further includes a step of impregnating an elastic polymer into the entangled sheet of microfine long fibers produced by the above method.

The present invention still further provides a substrate for leather-like sheets which is produced by the method mentioned above, and a grain-finished leather-like sheet and a suede-finished leather-like sheet each being produced by processing the substrate for leather-like sheets.

BEST MODE FOR CARRYING OUT THE INVENTION

The method of producing the entangled sheet of microfine long fibers of the present invention includes a step of forming a long-fiber web made of long fibers for forming microfine fibers, a step of entangling the long-fiber web to form a long-fiber entangled sheet, a step of shrinking the long-fiber entangled sheet to form a long-fiber shrunk sheet, and a step of converting the long fibers for forming microfine fibers in the long-fiber shrunk sheet to microfine long fibers, thereby producing an entangled sheet of microfine long fibers. Although the entangled sheet of microfine long fibers thus produced may be directly used as a substrate for leather-like sheets, preferably made into a substrate for leather-like sheets impregnated with an elastic polymer. The substrate for leather-like sheets is processed into a grain-finished leather-like sheet and suede-finished leather-like sheet.

In the present invention, the term "long fiber" means a fiber longer than a short fiber generally having a length of about 10 to 50 mm and a fiber not intentionally cut as so done in the production of short fibers. For example, the length of the long fibers before converted to microfine fibers is preferably 100 mm or longer, and may be several meters, hundreds of meter, or several kilo-meters as long as being technically possible to produce or being not physically broken.

The long fiber for forming microfine fibers used in the present invention is selected from sea-island fibers and multi-layered fibers which are produced by a method such as a mix spinning or a composite spinning, with a sea-island, long fiber for forming microfine fibers composed of a water-soluble, thermoplastic polyvinyl alcohol resin as the sea component and a water-insoluble thermoplastic resin as the island component being preferred.

Preferred examples of the water-insoluble thermoplastic resins include, but not limited to, polyester resins such as polyethylene terephthalate (referred to PET in some cases), polytrimethylene terephthalate, polybutylene terephthalate (referred to PBT in some cases), and polyester elastomers; polyamide resins such as nylon 6, nylon 66, nylon 610, aromatic polyamides, and polyamide elastomers; and fiber-forming polymers such as polyurethane resins, polyolefin resins, acrylonitrile resins, and modified resins thereof, with PET, PBT, nylon 6, and nylon 66 being preferably used because the final products excellent in the feel and properties upon use can be obtained. Particularly preferred are PET and its modified resins such as isophthalic acid-modified PET because the shrinking property of the long-fiber entangled sheet upon hot-water treatment is good.

The melting point of the water-insoluble thermoplastic resin is preferably from 160 to 350° C. in view of the shape stability and practicality. The method of measuring the melting point will be described below.

Taking the environmental pollution, the shrinking property upon the removal by dissolution, etc. into consideration, a water-soluble, thermoplastic polyvinyl alcohol resin (hereinafter referred to as "PVA resin") is preferably used as the sea component of the long fiber for forming microfine fibers. PVA resin shrinks largely upon the removal by dissolution to give an entangled sheet of microfine long fibers with a high density, thereby making the drapeability and feel of the resultant leather-like sheet closely resemble those of natural leathers. The apparent density of the entangled sheet of microfine long fibers is preferably 0.3 g/cm$^3$ or more in view of obtaining a leather-like feel, and more preferably 0.4 g/cm$^3$ or more in view of obtaining good, leather-like dense feel and properties. The upper limit is not specifically determined, but preferably 0.9 g/cm$^3$ or less in view of avoiding a hard feel. To achieve an apparent density within the above range, the content of PVA resin in the long fiber for forming microfine fibers is preferably from 5 to 70%, more preferably from 10 to 60%, and particularly preferably from 15 to 50%, each based on the mass, because the long-fiber entangled sheet stably exhibits an areal shrinkage of 35% or more in the shrinking treatment.

The viscosity-averaged degree of polymerization of PVA resin (hereinafter referred to merely as "degree of polymerization") is preferably from 200 to 500, more preferably from 230 to 470, and still more preferably from 250 to 450. If being 200 or higher, a melt viscosity sufficient for making PVA resin into composite fibers is obtained. If being 500 or lower, the melt viscosity is not excessively high and PVA resin is easily ejected from a spinning nozzle. PVA resin having a low polymerization degree of 500 or less is advantageous because the dissolving speed upon the hot-water treatment is high.

The polymerization degree (P) is measured according to JIS K6726, in which PVA resin is re-saponified and purified, and then measured for its intrinsic viscosity [η] in water at 30° C. The polymerization degree is calculated from the following equation:

$$P=([\eta]\times 10^3/8.29)^{(1/0.62)}.$$

The object of the present invention is well achieved when the polymerization degree is within a range from 200 to 500.

The saponification degree of PVA resin is preferably from 90 to 99.99%, more preferably from 93 to 99.98%, still more preferably from 94 to 99.97%, and particularly preferably from 96 to 99.96%, each based on mole. If being 90 mol % or more, the heat stability of PVA resin is good and the defective melt spinning due to thermal decomposition and gelation can be avoided. In addition, the biodegradability is good. Further, the water-solubility of PVA resin is not reduced according to the kind of the co-monomer described below, to enable the stable production of the long fiber for forming microfine fibers. It is difficult to stably produce PVA having a saponification degree higher than 99.99 mol %.

PVA resin is biodegradable and decomposed to water and carbon dioxide by an activated sludge treatment or by being laid underground. It is preferred to treat a PVA-containing waste water, which is resulted from the removal of PVA resin by dissolution, by activated sludge. PVA resin is decomposed within a period of from two days to one month when the PVA-containing waste water is continuously treated by activated sludge. Since the combustion heat is low to impose little load of heat to an incinerator, PVA resin may be incinerated after drying the PVA-containing waste water.

The melting point of PVA resin (Tm) is preferably from 160 to 230° C., more preferably from 170 to 227° C., and still more preferably from 175 to 224° C., and particularly preferably from 180 to 220° C. If being 160° C. or higher, the reduction in the fiber tenacity of PVA resin due to reduced crystallinity can be avoided. In addition, PVA resin has a good heat stability and fiber-forming property. If being 230° C. or lower, the long fiber for forming microfine fibers can be stably produced because the melt-spinning temperature can be made sufficiently lower than the decomposition temperature of PVA. The measuring method of the melting point will be described below.

PVA resin is produced by saponifying a resin mainly constituted by vinyl ester units. Examples of vinyl monomers for the vinyl ester units include vinyl formate, vinyl acetate, vinyl propionate, vinyl valerate, vinyl caprate, vinyl laurate, vinyl stearate, vinyl benzoate, vinyl pivalate and vinyl versatate, with vinyl acetate being preferred in view of easily producing PVA resin.

PVA resin may be homo PVA or modified PVA introduced with co-monomer units, with the modified PVA being preferred in view of a good melt spinnability, water solubility and fiber properties. In view of a good copolymerizability, melt spinnability and water solubility, preferred examples of the co-monomers are α-olefins having 4 or less carbon atoms such as ethylene, propylene, 1-butene and isobutene; and vinyl ethers such as methyl vinyl ether, ethyl vinyl ether, n-propyl vinyl ether, isopropyl vinyl ether and n-butyl vinyl ether. The molar content of the co-monomer units in PVA is preferably from 1 to 20%, more preferably from 4 to 15%, and still more preferably from 6 to 13%. Particularly preferred is ethylene-modified PVA, because the fiber properties are enhanced when the co-monomer unit is ethylene. The molar content of the ethylene units in the ethylene-modified PVA is preferably from 4 to 15% and more preferably from 6 to 13%.

PVA resin can be produced by a known method such as bulk polymerization, solution polymerization, suspension polymerization, and emulsion polymerization. Generally, a bulk polymerization or solution polymerization in the absence of solvent or in a solvent such as alcohol are employed. Examples of the solution for the solution polymerization include lower alcohols such as methyl alcohol, ethyl alcohol and propyl alcohol. The copolymerization is performed in the presence of a known initiator, for example, an azo initiator or peroxide initiator such as a,a'-azobisisobutyronitrile, 2,2'-azobis(2,4-dimethyl-varelonitrile), benzoyl peroxide, and n-propyl peroxycarbonate. The polymerization temperature is not critical and a range of from 0 to 150° C. is recommended.

The long fiber web made of fibers for forming microfine fibers may be efficiently produced by a spun-bond method combined with a melt spinning. For example, PVA resin and a water-insoluble thermoplastic resin are respectively melt-kneaded in different extruders. The flows of molten resins are introduced to a spinning head through a combining nozzle and ejected from a nozzle. The ejected composite long fibers are cooled by a cooling apparatus, drawn to an intended fineness by air jet with a speed corresponding to a take-up speed of 1000 to 6000 m/min using a sucking apparatus, and then collected on a moving surface. After partially pressing the collected long fibers, if needed, the long fiber web is obtained. In view of easiness of handling in the process, the fineness of the long fiber for forming microfine fibers is preferably from 1 to 5 dtex and the mass per unit are is preferably from 20 to 500 g/m$^2$. It is preferred to regulate the number of islands such that the average single fiber fineness of the resultant microfine long fibers falls within a range preferably from 0.0003 to 0.5 dtex and more preferably from 0.001 to 0.2 dtex, because a leather-like sheet excellent in the flexibility and appearance and a suede-finished leather-like sheet having a good dyeability are obtained. The average single fiber fineness of the microfine long fibers constituting the suede-finished artificial leather can be determined, for example, by observing the cross section or surface of the suede-finished artificial leather under a transmission electron microscope.

After oiling the long fiber web thus produced with an oil agent such as an anti-needle break oil agent of silicone, mineral oil or other types, an antistatic oil agent and an entangling oil agent, the entangling treatment is conducted in a known manner. A needle punching is preferred for a three-dimensional entanglement and easiness of increasing the apparent density of the resultant sheet. If needed, a stack obtained by superposing two or more long fiber webs using a crosslapper, etc. may be oiled and then entangled. Using such stack, the unevenness of mass per unit area is preferably reduced. The number of the superposed long fiber webs and the mass per unit area of the stack may be properly determined according to the intended thickness of the leather-like sheet. The overall mass per unit area of the superposed webs is preferably from 100 to 1000 g/m$^2$ because of easiness of handling.

In the entangling treatment, the superposed webs are entangled so as to produce a long-fiber entangled sheet having an interlaminar peel strength of 2 kg/2.5 cm or more. The interlaminar peel strength is preferably 4 kg/2.5 cm or more because the feel and strength of the leather-like sheet are excellent. The degree of the three-dimensional entanglement can be evaluated by the interlaminar peel strength. If the interlaminar peel strength is less than 2 kg/2.5 cm, the entanglement is insufficient, and a leather-like sheet having a sufficient strength and natural leather-like dense feel cannot be obtained even when being highly densified by the shrinking treatment such as a hot water shrinking. Also, the wrinkle defect due to slippage of fibers occurs. The upper limit of the interlaminar peel strength is not specifically determined, but preferably 30 kg/2.5 cm or less in considering the balance between the load of needle punching and feel, particularly, considering the problem such as the needle breaking.

The conditions of needle punching such as the kind and amount of the oil agent, the shape of needle, the needling depth and the number of punching are not specifically limited as long as the interlaminar peel strength within the above range is obtained. For example, although the needling is more efficient as the number of barbs increases, the number of barbs is selected from 1 to 9 so as not to cause the needle breaking. The needling depth may be set so that the barb of needle reaches the surface of the superposed webs and a strong needle mark is not made. The number of needle punching is preferably from 500 to 5000 punches/cm$^2$ although depending upon the shape of needle and the kind and amount of the oil agent. The mass per unit area after the entangling treatment is preferably at least 1.5 times by mass before the entangling treatment, and more preferably at least 1.7 times because the wrinkling can be easily prevented. The upper limit is not specific and preferably 4 times or less in view of performing the process successfully and avoiding the increase of production costs due to reduced processing speed.

The long-fiber entangled sheet produced by the entangling treatment such as needle punching is then subjected to a shrinking treatment. To use as the substrate for leather-like sheets, the areal shrinkage in the shrinking treatment expressed by the formula:

$$[(\text{area before shrinking}-\text{area after shrinking})/\text{area before shrinking}]\times 100,$$

is required to be 35% or more. If less than 35%, the apparent density of the resultant entangled sheet of microfine long fibers is not sufficiently high, to make it difficult to retain the shape of the sheet. This in turn adversely affects the handling ability and effect of processing in the production step of the substrate for leather-like sheets impregnated with an elastic polymer, and a substrate for leather-like sheets having a sufficient strength is not obtained. In considering the limit of physical shrinking and feel, the upper limit of the areal shrinkage is preferably 80% or less.

The shrinking treatment may be conducted by a known method, preferably by a hot water treatment or a steam heating treatment.

The hot water treatment may be made by simultaneously performing the shrinking treatment and the conversion to microfine fibers which includes the removal by dissolution (removal by extraction). Preferably, the hot water treatment is made in a two-stage manner of the shrinking treatment and the extraction treatment, because the shrinking efficiency is high and the extraction can be done simultaneously, to make the process efficient. For example, the long-fiber entangled sheet is, in the first stage, immersed for 5 to 300 s in a hot water of preferably from 65 to 85° C., more preferably from 70 to 80° C., and in the second stage, immersed for 100 to 600 s in a hot water of preferably from 85 to 100° C., more preferably from 90 to 100° C.

In the steam heating treatment, the long-fiber entangled sheet is heat-treated for 60 to 600 s in a steam atmosphere of a relative humidity of preferably 75% or more, more preferably 90% or more. If the relative humidity is 75% or more, the quick drying of the water adhered to the long-fiber entangled sheet is prevented to ensure the areal shrinkage of 35% or more. The temperature for the shrinking treatment (temperature of atmosphere) is preferably from 60 to 130° C., because the apparatus is easily operated and the long-fiber entangled sheet shrinks largely. Since PVA resin is not completely dissolved, the steam heating treatment is used in the production of clothes with a small thickness. The selection of the hot water treatment or the steam heating treatment is carried out according to the apparatus, process and kind of final product.

The shrinking treatment is continued until the mass per unit area after the shrinking treatment reaches 1.2 to 4 times (by mass) the mass per unit area before the shrinking treatment, preferably 1.3 to 4 times (by mass) because a suede-finished appearance having a leather-like dense feel, a high nap density, a high quality and a good writing effect can be obtained. By the shrinking treatment described above, the long-fiber entangled sheet shrinks in an areal shrinkage of 35% or more and the long fibers for forming microfine fibers are converted to microfine long fibers having an average single fiber fineness of preferably from 0.0003 to 0.5 dtex, to give the entangled sheet of microfine long fibers of the invention. The thickness thereof is preferably from 0.2 to 10 mm and the mass per unit area is preferably from 50 to 3500 g/m$^2$, although depending upon the end use of the entangled sheet of microfine long fibers.

The entangled sheet of microfine long fibers has a dense feel ever known for the nonwoven fabric made of only fibers, and can be directly used as the substrate of grain-finished or suede-finished leather-like sheets. Preferably made into a substrate for leather-like sheets having more stable shape retention by impregnating an elastic polymer as the binder. A woven or knitted fabric may be united to the entangled sheet of microfine long fibers by a known laminating method unless the object and effect of the invention are not impaired.

The elastic polymer (binder resin) usable in the present invention may be selected from any of polymers as long as they are elastomeric and exemplified by polyurethane, styrene-butadiene rubber (SBR), acrylonitrile-butadiene rubber (NBR), polyamino acid, and acrylic adhesive, with polyurethane being preferably used because the feel and properties of the leather-like sheet are good. An elastic polymer of aqueous emulsion type is more preferably used because it needs no organic solvent and is environmentally friend.

The impregnation is effected, for example, by a method in which a solution or aqueous emulsion of an elastic polymer is impregnated and then wet-solidified or a method in which a solution or aqueous emulsion of an elastic polymer is impregnated and then dried for adhesion. The heat gelation temperature of the aqueous emulsion is preferably 30° C. or higher but less than 60° C., more preferably from 32 to 58° C. The heat gelation temperature can be regulated within the above range by selecting the kind of elastic polymer, the concentration of emulsion and the addition amount of a heat gelling agent, for example, inorganic salt such as sodium sulfate or using a known thickener. In the known methods, the heat gelation temperature is generally set at 60° C. or higher in view of easiness of handling. However, in the present invention, the heat gelation temperature is set at less than 60° C. so as to distribute the elastic polymer uniformly throughout the sheet. If less than 60° C., the uneven distribution of the elastic polymer toward the surface of the entangled sheet of microfine long fibers can be avoided because the solidification before the elastic polymer migrates inside is prevented. In addition, the wrinkling can be avoided because the elastic polymer uniformly distributed prevents each of the microfine long fibers in the substrate for leather-like sheets from moving. If 30° C. or higher, the storage stability of the emulsion is good because the emulsion is prevented from being aggregated. The amount of the elastic polymer to be impregnated is preferably 35% or less, more preferably from 1 to 35%, and still more preferably from 1 to 15%, each on the basis of the total mass of the resultant substrate for leather-like sheets (entangled sheet of microfine long fibers+elastic polymer). If being 35% or less, a leather-like sheet having a soft feel and sufficient strength is obtained.

The substrate for leather-like sheets is made into a suede-finished leather-like sheet by the napping of the surface, softening treatment and dyeing treatment. The napping is effected by a known method such as a buffing treatment using a sand paper or card clothing. The entangled sheet of microfine long fibers is made into a grain-finished or semi grain-finished leather-like sheet by forming a skin layer on the surface thereof by a known method during or after the impregnation of the elastic polymer, and by subsequent steps of embossing process, softening treatment and dyeing treatment. The leather-like sheets thus produced are resistant to the wrinkling during their production and have a natural leather-like dense feel and drapeability due to long fibers, and therefore, suitable as the materials for clothes, shoes, gloves and interior furniture such as sofa.

In the production of a leather-like sheet using sea-island long fibers for forming microfine fibers, it is generally difficult to prevent the moving of the long fibers due to shrinking in the high-temperature steps such as the step of removing the sea component and the dyeing step, to form irregular wrinkles throughout the surface of the sheet in many cases. This becomes more remarkable particularly when the content of the binder resin is low. In the method of the present invention for producing the entangled sheet of microfine long fibers containing no elastic polymer or the substrate for leather-like sheets containing a small amount of the elastic polymer, the conversion to microfine fibers is effected by removing PVA resin (sea component) in the absence of or before the impregnation of the elastic polymer. With this technique, the distortion of the microfine long fibers (island component) caused in the entangling step and the conversion step to microfine fibers can be sufficiently relaxed. In addition, the resultant sheet has a high apparent density because of a sufficient entanglement and a large shrinking, this making the microfine long fibers and sheet difficult to stretch, to improve the shape retention of the entangled sheet of microfine long fibers and substrate for leather-like sheets. The improved shape retention prevents the wrinkling in the production of the leather-like sheet to give the leather-like sheet with little wrinkle. Further, the production method of the present invention is not detrimental to the environment because the leather-like sheet with good properties is produced without using an organic solvent which is harmful to human body and environment.

EXAMPLES

The present invention will be described with reference to the examples. However, it should be noted that the scope of the present invention is not limited to the following examples. The part(s) and % in the following examples are based on the mass, unless otherwise noted.

The average single fiber fineness, the melting point of PVA resin, and the interlaminar peel strength were measured by the following methods.

(A) Average Single Fiber Fineness

The cross-sectional area of the fibers forming the sheet was measured by a scanning electron microscope (magnification: several hundreds to several thousands). The average single fiber fineness was calculated from the measured area and the density of the resin which formed the fibers.

(B) Melting Point

The peak top temperature of the endothermic peak was measured using a differential scanning calorimeter (TA3000 available from Mettler Inc.) by heating a resin to 300° C. at a rate of 10° C./min in a nitrogen atmosphere, then cooling to room temperature, and then heating again to 300° C. at a rate of 10° C./min.

(C) Interlaminar Peel Strength

A test piece was prepared by cutting a long-fiber entangled sheet to 23 cm in the length direction and 2.5 cm in the width direction. On the length-wise end surface of the test piece, a slit was made by cutting with a razor along the line which was centered in the width direction. Then, the sheet was peeled from the slit in a peeled length of about 10 cm. The edges of two peeled portions were cramped by chucks and the sheet was peeled away using a tensile tester at a pulling speed of 100 mm/min to measure the peel strength. The average peel strength was determined from the flat portion of the obtained stress-strain curve (SS curve). The results were given by the average on three test pieces.

Production Example 1

Production of Water-Soluble, Thermoplastic Polyvinyl Alcohol Resin

A 100-L pressure reactor equipped with a stirrer, a nitrogen inlet, an ethylene inlet and an initiator inlet was charged with 29.0 kg of vinyl acetate and 31.0 kg of methanol. After raising the temperature to 60° C., the reaction system was purged with nitrogen by bubbling nitrogen for 30 min. Then, ethylene was introduced so as to adjust the pressure of the reactor to 5.9 kgf/cm$^2$. A 2.8 g/L methanol solution of 2,2'-azobis(4-methoxy-2,4-dimethylvaleronitrile) (polymerization initiator) was purged with nitrogen by nitrogen gas bubbling. After adjusting the temperature of reactor to 60° C., 170 mL of the initiator solution was added to initiate the polymerization. During the polymerization, the pressure of reactor was maintained at 5.9 kgf/cm$^2$ by introducing ethylene, the polymerization temperature was maintained at 60° C., and the initiator solution was continuously added at a rate of 610 mL/h. When the conversion of polymerization reached 70% after 10 h, the polymerization was terminated by cooling. After releasing ethylene from the reactor, ethylene was completely removed by bubbling nitrogen gas. The non-reacted vinyl acetate monomer was removed under reduced pressure to obtain a methanol solution of ethylene-modified polyvinyl acetate (modified PVAc) which was then diluted to 50% concentration with methanol. The modified PVAc was saponified by adding 46.5 g of an alkali solution (10% methanol solution of NaOH) to 200 g of the 50% methanol solution of modified PVAc (NaOH/vinyl acetate unit=0.10/1 by mole). After about 2 min of the addition of the alkali solution, the system was gelated. The gel was crushed by a crusher and allowed to stand at 60° C. for one hour to allow the saponification to further proceed. Then, 1000 g of methyl acetate was added to neutralize the alkali. After confirming the completion of neutralization by phenolphthalein indicator, white solid PVA was separated by filtration. The white solid PVA was added with 1000 g of methanol and allowed to stand at room temperature for 3 h for washing. After repeating the above washing operation three times, the liquid was centrifugally removed and the solid remained was dried at 70° C. for 2 days to obtain an ethylene-modified PVA (modified PVA). The saponification degree of the modified PVA was 98.4 mol %. The modified PVA was incinerated and dissolved in an acid for analysis by atomic-absorption spectroscopy. The content of sodium was 0.03 part by mass based on 100 parts by mass of the modified PVA.

After repeating three times the reprecipitation-dissolution operation in which n-hexane is added to the methanol solution of the modified PVAc obtained by removing the non-reacted vinyl acetate monomer after the polymerization and acetone is then added, the precipitate was vacuum-dried at 80° C. for 3 days to obtain a purified, modified PVAc. The modified PVAc was dissolved in d6-DMSO and analyzed by 500 MHz H-NMR (JEOL GX-500) at 80° C. The content of ethylene unit was 10 mol %. After saponifying the modified PVAc (alkali/vinyl acetate unit=0.5/1 by mole), the resultant gel was crushed and the saponification was allowed to further proceed by standing at 60° C. for 5 h. The saponification product was extracted by Soxhlet with methanol for 3 days and the obtained extract was vacuum-dried at 80° C. for 3 days to obtain a purified, modified PVA. The average polymerization degree of the purified PVA was 330 when measured by a method of JIS K6726. The content of 1,2-glycol linkage and the content of three consecutive hydroxyl groups in the purified, modified PVA were respectively 1.50 mol % and 83% when measured by 5000 MHz H-NMR (JEOL GX-500). A 5% aqueous solution of the purified, modified PVA was made into a cast film of 10 μm thick, which was then vacuum-dried at 80° C. for one day and then measured for the melting point in the manner described above. The melting point was 206° C.

Example 1

The modified PVA (water-soluble, thermoplastic polyvinyl alcohol resin: sea component) produced above and an isophthalic acid-modified polyethylene terephthalate (degree of modification of 6 mol %: island component) were ejected at 260° C. form a spinneret for melt composite spinning (number of islands: 25/fiber) in a sea component/island component ratio of 30/70 (by mass). The ejector pressure was regulated such that the spinning speed was 4500 m/min. The long fibers having an average fineness of 2.0 dtex were collected on a net, to obtain a spun-bonded sheet (long fiber web) having a mass per unit area of 30 g/m$^2$.

A superposed web having a total mass per unit area of 180 g/m$^2$ was prepared by crosslapping six spun-bonded sheets. After spraying an oil agent for preventing needle break, the superposed web was entangled by needle punching alternately from both sides at a density of 3600 punch/cm$^2$ and a punching depth of 10 mm using single-barb needles with a tip-to-barb distance of 5 mm. The areal shrinkage by the needle punching treatment was 53%. The long-fiber entangled sheet obtained by the needle punching had a mass per unit area of 340 g/m$^2$ and an interlaminar peel strength of 9.2 kg/2.5 cm.

The long-fiber entangled sheet was immersed in a hot water of 70° C. for 90 s to cause the area-shrinking due to the stress relaxation of the island component, and then immersed in a hot water of 95° C. for 10 min to remove the modified PVA by dissolution, to obtain an entangled sheet of microfine long fibers. The areal shrinkage measured after drying was 49%, the mass per unit area was 490 g/m$^2$, the apparent density was 0.55 g/cm$^3$, and the average single fiber fineness of the microfine long fibers was 0.1 dtex.

To Super Flex E-4800 (aqueous polyurethane emulsion manufactured by Dai-Ichi Kogyo Seiyaku Co., Ltd.) regulated to a 40% concentration of a solid resin component, sodium sulfate (heat gelling agent) was added in an amount of one part per 40 parts of the solid resin component, to prepare a heat gelling emulsion (heat gelation temperature=55° C.). The emulsion was impregnated to the entangled sheet of microfine long fibers, dried and cured, to obtain a substrate for leather-like sheets having an R/F ratio of 5/95 (R is the mass of the elastic polymer and F is the mass of the microfine long fibers). The surface of the substrate was napped by buffing and dyed with a disperse dye, to obtain a wrinkle-less suede-finished leather-like sheet having a natural leather-like dense feel. The obtained sheet had strength suitable for the application to interior, car sheet and other products.

Example 2

To Evaphanol AP-12 (aqueous polyurethane emulsion manufactured by Nicca Chemical Co., Ltd.) regulated to a 20% concentration of a solid resin component, sodium sulfate (heat gelling agent) was added in an amount of 6 parts per 100 parts of the solid resin component, to prepare a heat gelling emulsion (heat gelation temperature=53° C.). The emulsion was impregnated to the entangled sheet of microfine long fibers, dried and cured in the same manner as in Example 1, to obtain a leather-like sheet.

The thickness was 1.0 mm, the average single fiber fineness of the microfine long fibers was 0.08 dtex, the R/F ratio was 20/80, and no wrinkle was observed. The cross-sectional observation on the sheet showed that the elastic polymer was uniformly distributed in the width direction. The surface of the leather-like sheet was napped by buffing and dyed with a disperse dye, to obtain a suede-finished leather-like sheet having a thickness of 0.9 mm. The obtained sheet was free from wrinkle and had a good drapeability resulted from long fibers, good writing effect, and strength suitable for the application to interior, car sheet and other products.

Example 3

A suede-finished artificial leather was produced in the same manner as in Example 2 except for changing the concentration of solid resin component in the emulsion to 30%, the amount of sodium sulfate to three parts per 100 parts of the solid resin component and the heat gelation temperature to 48° C. The obtained sheet was free from wrinkle and had a good drapeability resulted from long fibers, good writing effect, and strength suitable for the application to interior, car sheet and other products.

Example 4

A suede-finished artificial leather was produced in the same manner as in Example 2 except for changing the concentration of solid resin component in the emulsion to 40%, the amount of sodium sulfate to 1.5 parts per 100 parts of the solid resin component and the heat gelation temperature to 45° C. The obtained sheet was free from wrinkle and had a good drapeability resulted from long fibers, good writing effect, and strength suitable for the application to interior, car sheet and other products.

Example 5

A suede-finished artificial leather was produced in the same manner as in Example 2 except for using a shrinkable polyamide having a melt flow rate (255° C., 325 g of load, and 2 mm ϕ of nozzle diameter) of 10 g/10 min as the island component of the long fibers for forming microfine fibers. The obtained sheet was free from wrinkle and had a good drapeability resulted from long fibers, good writing effect, and strength suitable for the application to interior, car sheet and other products.

Example 6

A suede-finished artificial leather was produced in the same manner as in Example 1 except for preparing a long-fiber entangled sheet having an interlaminar peel strength of 2.3 kg/2.5 cm and an areal shrinkage of 55% by regulating the amount of the oil agent and needle-punching density. The obtained sheet was free from wrinkle and had a good drapeability resulted from long fibers, good writing effect, and strength suitable for the application to interior, car sheet and other products.

Example 7

A suede-finished artificial leather was produced in the same manner as in Example 1 except for preparing a long-fiber entangled sheet having an interlaminar peel strength of 14 kg/2.5 cm and an areal shrinkage of 38% by regulating the amount of the oil agent and needle-punching density. The obtained sheet was free from wrinkle and had a good drapeability resulted from long fibers, good writing effect, and strength suitable for the application to interior, car sheet and other products.

Comparative Example 1

A long-fiber entangled sheet was prepared in the same manner as in Example 1 except for changing the needle-punching density to 120 punch/cm$^2$. The interlaminar peel strength of the long-fiber entangled sheet was 0.8 kg/2.5 cm. The obtained long-fiber entangled sheet was subjected to the shrinking/conversion treatment in the same manner as in Example 1, to obtain an entangled sheet of microfine long fibers. The areal shrinkage was 48%. The obtained sheet was unsuitable as the material for the leather-like sheet because of its insufficient strength and poor dense feel.

Comparative Example 2

A long-fiber entangled sheet prepared in the same manner as in Example 1 was dry-heated at 170° C. for 20 min, to relax the distortion of the island component. The sheet was immersed in a hot water of 70° C. for 90 s for shrinking and immersed in a hot water of 95° C. for 10 min to remove the modified PVA by dissolution, to obtain an entangled sheet of microfine long fibers. The areal shrinkage measured after drying was 12%. The obtained entangled sheet of microfine long fibers was unsuitable as the material for the leather-like sheet.

Comparative Example 4

A leather-like sheet was produced in the same manner as in Example 1 except for changing the sea component of the long fibers for forming microfine fibers to polyethylene. The polyethylene was removed by dissolution to toluene, during which the island component (isophthalic acid-modified polyethylene terephthalate) was swelled to increase the elongation during passing through the process, thereby making the handling difficult. The sheet was significantly wrinkled and poor in the feel and dense feel, to make it unsuitable as the commercial products.

INDUSTRIAL APPLICABILITY

According to the method of the present invention, an entangled sheet of microfine long fibers suitable for the substrate of leather-like sheets can be produced. By impregnating an elastic polymer, the entangled sheet of microfine long fibers can be made into a substrate for leather-like sheets. By napping the surface, the substrate for leather-like sheets can be made into a suede-finished or nubuck-finished leather-like sheet. Also, the substrate for leather-like sheets can be made into a grain-finished leather-like sheet by coating a resin on its surface or melting or dissolving its surface with heating or solvent so as to form a resin layer thereon. These leather-like sheets have a natural leather-like massive and dense feel and are excellent in mechanical properties, softness and aesthetically pleasing appearance. Therefore, the leather-like sheets are suitable as the materials for leather-like products such as shoes, game balls, furniture, seats for vehicles, clothes, gloves, baseball gloves, briefcases, belts and handbags.

What is claimed is:

1. A method of producing a wrinkle-free entangled sheet of microfine long fibers which comprises no elastic polymer, the method comprising:

forming a long-fiber web made of long fibers for forming microfine fibers, the long fibers comprising a water-soluble, thermoplastic polyvinyl alcohol resin and a water-insoluble thermoplastic resin;

entangling the long-fiber web to form a long-fiber entangled sheet;

shrinking the long-fiber entangled sheet to form a long-fiber shrunk sheet; and converting the long fibers for forming microfine fibers in the long-fiber shrunk sheet to microfine long fibers, thereby producing the wrinkle-free entangled sheet of microfine long fibers which comprise no elastic polymer, wherein the entangling the long-fiber web is performed such that the long-fiber entangled sheet has an interlaminar peel strength of 2 kg/2.5 cm or more, and wherein the shrinking the long-fiber entangled sheet is performed such that an areal shrinkage is 35% or more.

2. The method according to claim 1, wherein two or more long fiber webs are superposed and then entangled to form the long-fiber entangled sheet.

3. The method according to claim 1, wherein the entangling is conducted by needle punching.

4. The method according to claim 1, wherein the shrinking is conducted by a treatment with hot water or steam.

5. The method according to claim 1, wherein the thermoplastic polyvinyl alcohol resin has a viscosity-averaged polymerization degree of from 200 to 500, a saponification degree of from 90 to 99.99 mol %, and a melting point of from 160 to 230° C.

6. The method according to claim 1, wherein the microfine long fibers have an average single fiber fineness of from 0.0003 to 0.5 dtex.

7. The method according to claim 1, wherein the shrinking and the converting are conducted simultaneously.

8. The method of claim 4, wherein the shrinking is conducted by treatment with hot water.

9. The method of claim 2, wherein the thermoplastic polyvinyl alcohol resin has a viscosity-averaged polymerization degree of from 200 to 500, a saponification degree of from 90 to 99.99 mol %, and a melting point of from 160 to 230° C.

10. The method of claim 3, wherein the thermoplastic polyvinyl alcohol resin has a viscosity-averaged polymerization degree of from 200 to 500, a saponification degree of from 90 to 99.99 mol %, and a melting point of from 160 to 230° C.

11. The method of claim 4, wherein the thermoplastic polyvinyl alcohol resin has a viscosity-averaged polymerization degree of from 200 to 500, a saponification degree of from 90 to 99.99 mol %, and a melting point of from 160 to 230° C.

12. The method of claim 2, wherein the microfine long fibers have an average single fiber fineness of from 0.0003 to 0.5 dtex.

13. The method of claim 3, wherein the microfine long fibers have an average single fiber fineness of from 0.0003 to 0.5 dtex.

14. The method according to claim 1, wherein the water-insoluble thermoplastic resin is a modified polyethylene terephthalate resin.

15. A method of producing a substrate for artificial leather sheets, which comprises impregnating an elastic polymer into the wrinkle-free entangled sheet of microfine long fibers produced by the method as defined in claim 1.

16. A substrate for artificial leather sheets which is produced by the method as defined in claim 15.

17. A grain-finished artificial leather sheet which is produced by forming a skin layer on a surface of the substrate for artificial leather sheets as defined in claim 16.

18. A suede-finished artificial leather sheet which is produced by forming a napped layer on a surface of the substrate for artificial leather sheets as defined in claim 16.

* * * * *